US012552578B1

(12) United States Patent
Mulholland et al.

(10) Patent No.: US 12,552,578 B1
(45) Date of Patent: Feb. 17, 2026

(54) PACKAGING CONTAINER FOR AUTOMOTIVE TENSIONER KIT

(71) Applicant: Automotive Tensioners Inc., Southlake, TX (US)

(72) Inventors: Patrick Mulholland, Southlake, TX (US); Joel Thompson, Southlake, TX (US)

(73) Assignee: Automotive Tensioners Inc., Southlake, TX (US)

( * ) Notice: Subject to any disclaimer, the term of this patent is extended or adjusted under 35 U.S.C. 154(b) by 41 days.

(21) Appl. No.: 18/606,234

(22) Filed: Mar. 15, 2024

Related U.S. Application Data

(60) Provisional application No. 63/490,581, filed on Mar. 16, 2023.

(51) Int. Cl.
*B65D 5/48* (2006.01)
*B65D 85/67* (2006.01)
*B65D 85/68* (2006.01)

(52) U.S. Cl.
CPC ..... *B65D 5/48* (2013.01); *B65D 85/67* (2013.01); *B65D 85/68* (2013.01); *B65D 2585/6875* (2013.01)

(58) Field of Classification Search
USPC ..... 229/120.02, 120.36, 120.38
See application file for complete search history.

(56) References Cited

U.S. PATENT DOCUMENTS 2,280,544 A * 4/1942 Schaefer ..... B65D 5/48024 229/120.02
3,203,612 A * 8/1965 Schaefer ..... B65D 5/48038 229/120.36
3,767,106 A * 10/1973 Morgan ..... B65D 5/48038 229/120.36

* cited by examiner

*Primary Examiner* — Bryon P Gehman
(74) *Attorney, Agent, or Firm* — Phillips Murrah PC; Martin G. Ozinga; Cody J. Cooper

(57) ABSTRACT

A container for automotive tensioner replacement kits having at least three separate dividers for individually holding a tensioner, one or more pulleys, and associated hardware wherein the dividers may be constructed with one or more notches adapted to secure a serpentine belt from being undesirably deformed in shipping and handling while also holding components in a protected manner.

1 Claim, 3 Drawing Sheets

PACKAGING CONTAINER FOR AUTOMOTIVE TENSIONER KIT

CROSS-REFERENCE TO RELATED APPLICATIONS

Priority is claimed from U.S. Provisional Patent application Ser. No. 63/490,581 filed on Mar. 16, 2023, and incorporated by reference herein.

BACKGROUND OF INVENTION

1. Field of the Invention

In general, the present invention relates to a packaging container for automotive tensioner replacement kits. More particularly, the present invention provides a new and improved packaging container for automotive tensioners and associated pulleys, serpentine belt, and hardware that minimizes and or prevents damage to parts in the kit for shipping and handling.

2. Description of the Prior Art

In automotive engines, accessory belts are used to drive the air-conditioning compressor, power steering pump, water pump, the alternator, and so forth. In the past, multiple belts were utilized until the advent of a serpentine belt that would replace the need for multiple belts. Belt tensioners are extremely important in the proper operation of the current accessory belt drive system. A tensioner maintains the correct amount of tension on the belt at all times as it powers throughout its duty cycle. Belts, tensioners, and pulleys may break and or wear down over time. It is very common over the lifetime of an engine to need to replace these parts. Typically, the replacement parts are sold in kits that contain a tensioner, serpentine belt, and one or more pulleys.

In the prior art, it is not unusual for the parts kit to be thrown into a marginal container for transport and storage. The shipping and handling of these replacement kits are utilizing undesirable hap hazard containers that allow the parts to bang, rub, and deform the belt that can cause damage to the parts. They are also typically not made from recyclable materials.

Thus, there is a need for a new and improved packaging that provides a protective separation of kit parts to prevent damage to the kit parts during shipping and handling. The above discussed limitations in the prior art is not exhaustive. The current invention provides an inexpensive, time saving, and more reliable container where the prior art fails.

SUMMARY OF THE INVENTION

In view of the foregoing disadvantages inherent in the known types of container for automotive tensioner replacement kits now present in the prior art, the present invention provides a new and improved container. As such, the general purpose of the present invention, which will be described subsequently in greater detail, is to provide a new and improved container for automotive tensioner replacement kits, which has all the advantages of the prior art devices and none and or fewer of the disadvantages.

It is, therefore, contemplated that the present invention is a container for automotive tensioner replacement kits having at least three separate dividers for individually holding a tensioner, one or more pulleys, and associated hardware. The dividers may be constructed with one or more notches adapted to secure a serpentine belt from being undesirably deformed in shipping and handling.

There has thus been outlined, rather broadly, the more important features of the invention in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved container for automotive tensioner replacement kits that reduce and or prevent damage to the parts during shipping and handling.

Furthermore, another object of the present invention is a new and improved container for automotive tensioner replacement kits, which is of a durable and reliable construction and may be utilized for numerous types of automotive tensioner replacement kits.

Another object of the present invention is a new and improved container for automotive tensioner replacement kits, which is susceptible to a low cost of manufacture that accordingly is then susceptible to low prices of sale to the consuming industry, thereby making such a container available to those in the field.

Another object of the present invention is to provide a new and improved container for automotive tensioner replacement kits, which provides all of the advantages of the prior art while simultaneously overcoming some of the disadvantages normally associated therewith.

Still another object of the present invention is to provide a new and improved container for automotive tensioner replacement kits that is entirely recyclable, increases customer satisfaction, and so forth.

Another object of the present invention is to provide a new and improved container for automotive tensioner replacement kits that is stackable and store shelf friendly without damaging the contents.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings, and appendices.

DETAILED DESCRIPTION OF INVENTION

Figure 1:
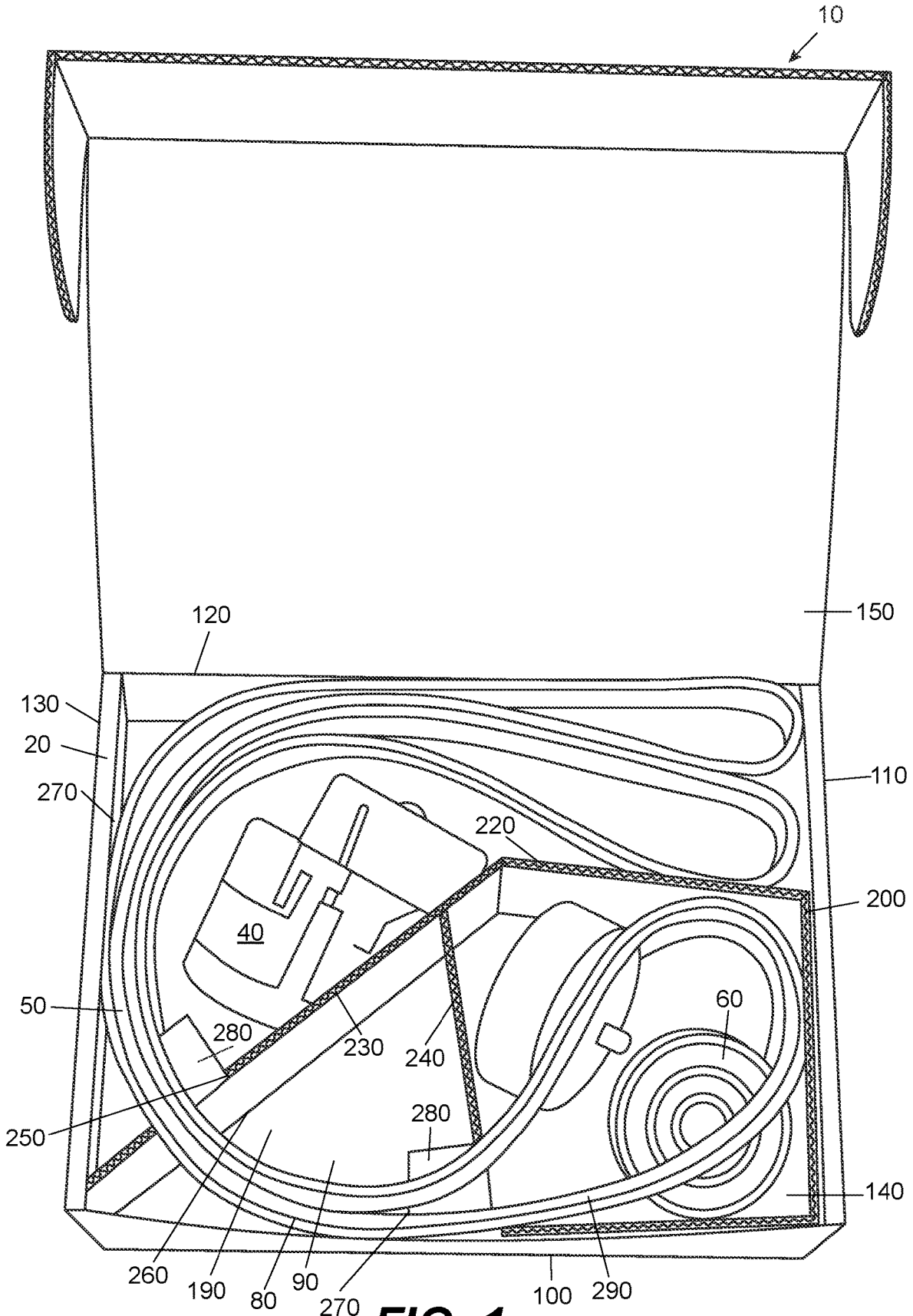
FIG. 1 is a general illustration of a preferred embodiment in accordance with the current invention.
Figure 2:
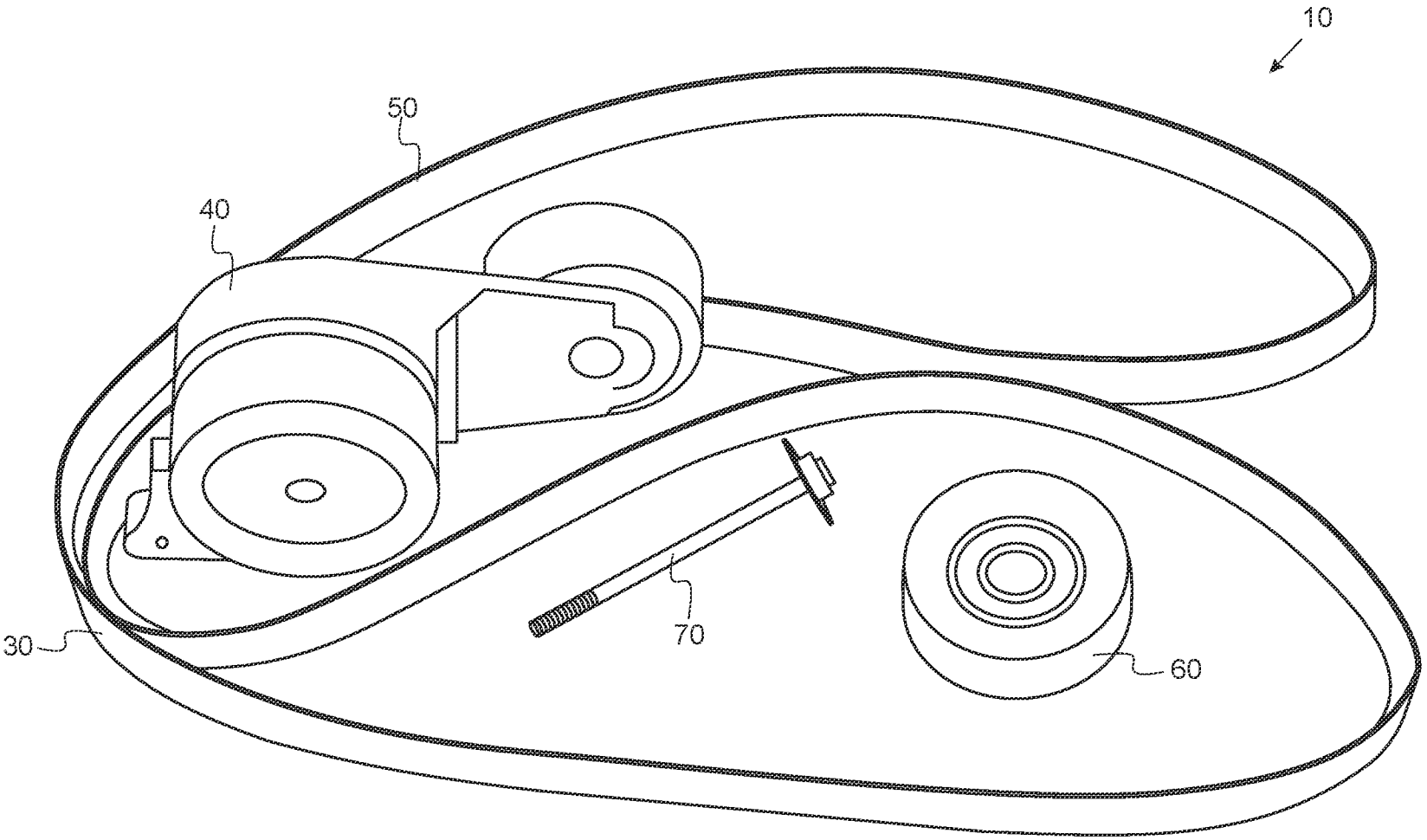
FIG. 2 is a general illustration of a preferred embodiment in accordance with the current invention depicting tensioner components.
Figure 3:
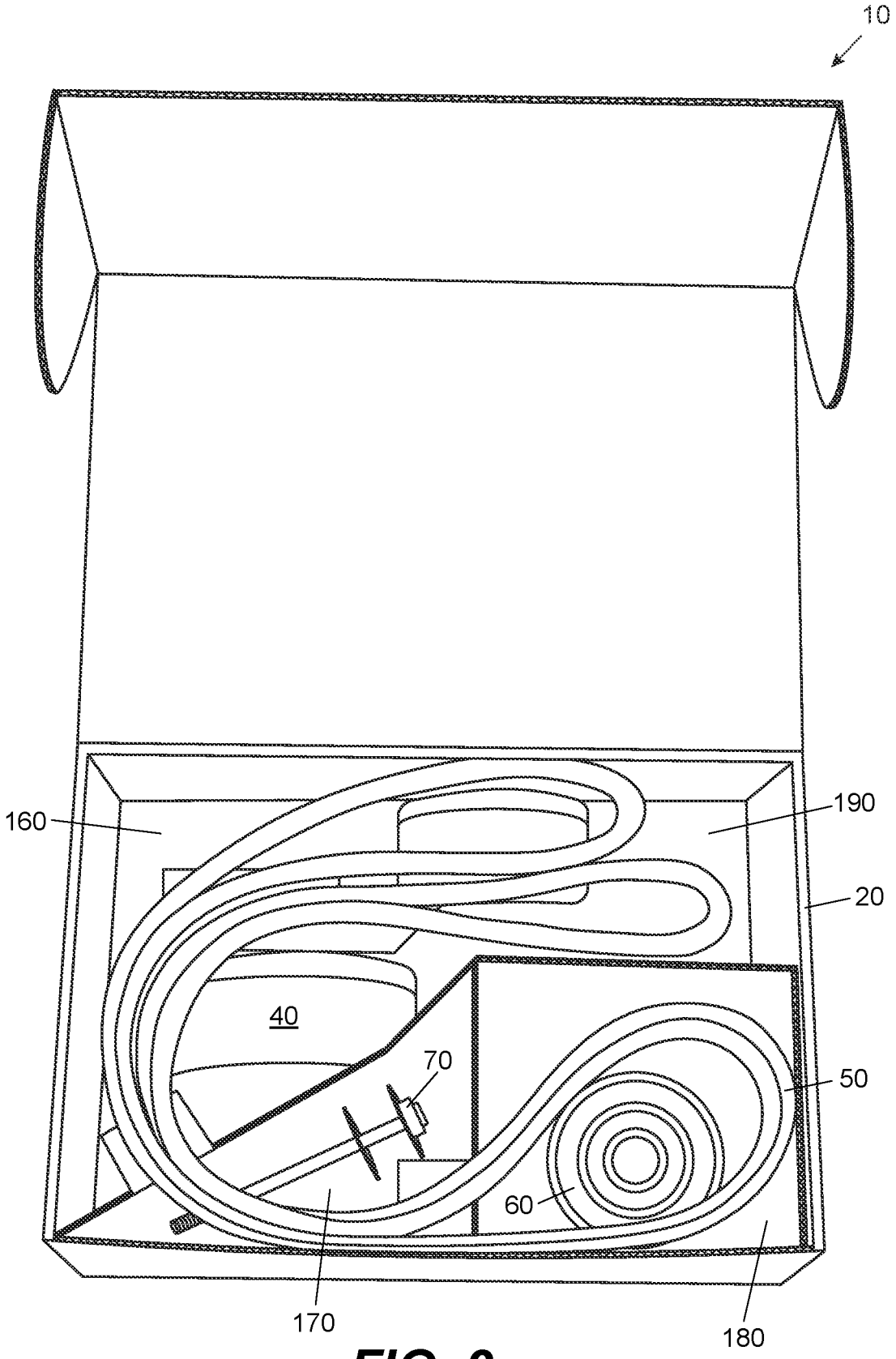
FIG. 3 is a general illustration of a preferred embodiment in accordance with the current invention.

Referring to the illustrations, drawings, and pictures, reference character 10 generally designates a new and improved container for automotive tensioner replacement kits constructed in accordance with the present invention. Invention 10 is generally used in automotive tensioner replacement kits for shipping and handling although it is understood other uses in which shipping and handling structures are required are also contemplated. For purposes of convenience, the reference numeral 10 may generally be utilized for the indication of the invention, portion of the invention, preferred embodiments of the invention and so on.

Referring to the illustrations and more particular to FIG. 1, container for automotive tensioner replacement kit 10 may compromise a container 20 for automotive tensioner replacement kits 30 having a tensioner 40, serpentine belt 50, one or more pulleys 60, and associated hardware 70 such as but not limited to bolts, washers, nuts and so forth.

Container 20 may be a recyclable cardboard material but is not limited to same having an exterior 80, an interior 90, a first wall 100, a second wall 110, a third wall 120, and a fourth wall 130. Container 20 may have a bottom 140 and a hinged top 150 although top may or may not be hingedly attached.

Interior 90 may have a first compartment 160, a second compartment 170, a third compartment 180 and may be collectively referred to as compartments 190. It is understood that interior 90 may have more or less compartments 190. It is contemplated compartments 190 may individually hold tensioner 40, one or more pulleys 60, and associated hardware 70 such as but not limited to bolts, nuts, washers and so forth in separate compartments 190.

Dividers 200 may comprise but is not limited to a first divider 220, second divider 230, third divider 240, and so forth. Dividers 200 may be of a one piece construction that generally splits and or forms into but is not limited to a first divider 220, second divider 230, third divider 240, and so forth forming compartments 190 of interior 90 of container 20.

Dividers 200 may have a top portion 250 and a bottom portion 260 that rests on bottom 140 of container 20 interior 90 and generally in contact and or near contact with hinged top 150. Dividers 200 may have notches 270 and flaps 280 therefrom adapted to cradle serpentine belt 50 near hinged top 150. This may prevent serpentine belt 50 from deforming across compartments 190 and also provide cushion 290 for tensioner 40, one or more pulleys 60, and associated hardware 70 from damage during shipping and handling. It is understood that serpentine belt 50 may lay across one or more compartments 190.

Changes may be made in the combinations, operations, and arrangements of the various parts and elements described herein without departing from the spirit and scope of the invention. Furthermore, names, titles, headings, and general division of the aforementioned are provided for convenience and therefore, should not be considered limiting.

What is claimed is:

1. An automotive tensioner replacement kit comprising:

a tensioner;

at least one pulley;

installation hardware;

a serpentine belt;

a cardboard container having an exterior, an interior, a first wall, a second wall, a third wall, a fourth wall, a bottom, and a hinged top;

a divider having top portion, a bottom portion that rests on said bottom of said interior of said cardboard container wherein said top portion having a first notch with a first flap and a second notch with a second flap;

wherein said divider is folded to form a first compartment for separately holding said tensioner, a second compartment for holding said installation hardware, and a third compartment to hold said at least one pulley respectively; and wherein said serpentine belt is positioned in said first notch and said second notch.

* * * * *